US012559880B2

(12) United States Patent
Leibman et al.

(10) Patent No.: US 12,559,880 B2
(45) Date of Patent: Feb. 24, 2026

(54) DRYER APPLIANCE AND INFUSER ASSEMBLY

(71) Applicant: Haier US Appliance Solutions, Inc., Wilmington, DE (US)

(72) Inventors: Alexander B. Leibman, Prospect, KY (US); Venkata Chakradhar Rangu, Louisville, KY (US); Jay Pareshbhai Shinde, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 1015 days.

(21) Appl. No.: 17/697,179

(22) Filed: Mar. 17, 2022

(65) Prior Publication Data

US 2023/0295862 A1 Sep. 21, 2023

(51) Int. Cl.
*D06F 58/20* (2006.01)
*D06F 58/04* (2006.01)

(52) U.S. Cl.
CPC ..... *D06F 58/203* (2013.01); *D06F 58/04* (2013.01)

(58) Field of Classification Search
CPC ..... D06F 58/203; D06F 58/04
See application file for complete search history.

(56) References Cited

U.S. PATENT DOCUMENTS

| | | | | |
|---|---|---|---|---|
| 3,108,465 | A | 10/1963 | Bochan | |
| 4,969,927 | A | 11/1990 | Schumann | |
| 6,571,993 | B2 | 6/2003 | Rodd et al. | |
| 6,584,633 | B2 | 7/2003 | Chute et al. | |
| 7,032,326 | B2 | 4/2006 | Hong | |
| 8,984,767 | B2 | 3/2015 | Grunert et al. | |
| 10,392,740 | B2 | 8/2019 | Chernetski et al. | |
| 10,745,853 | B2 | 8/2020 | Leibman et al. | |
| 2004/0216326 | A1* | 11/2004 | Kitamura | D06F 35/003 34/597 |
| 2005/0183208 | A1 | 8/2005 | Scheper et al. | |
| 2008/0263783 | A1* | 10/2008 | Pyo | D06F 58/203 134/6 |
| 2016/0215438 | A1 | 7/2016 | Chernetski et al. | |
| 2021/0115618 | A1* | 4/2021 | Lee | D06F 58/203 |

FOREIGN PATENT DOCUMENTS

| | | | |
|---|---|---|---|
| CA | 2485865 | C | 8/2007 |
| CA | 2380152 | C | 3/2008 |
| EP | 1072715 | A1 | 1/2001 |
| EP | 1564325 | B1 | 8/2005 |
| EP | 1907620 | B1 | 11/2010 |

(Continued)

*Primary Examiner* — Edelmira Bosques
*Assistant Examiner* — Bao D Nguyen
(74) *Attorney, Agent, or Firm* — Dority & Manning, P.A.

(57) ABSTRACT

A dryer appliance may include a cabinet, a drum, a supply line, an infuser reservoir, and an air impeller. The drum may be rotatably mounted within the cabinet, the drum defining a drying chamber for the receipt of clothes for drying. The supply line may define an air path in upstream fluid communication with the drying chamber. The supply line may extend from a line inlet to a line outlet. The infuser reservoir may be attached to the supply line along the air path and in fluid communication therewith. The air impeller may be mounted along the supply line in rotational engagement with the drum to be rotated by the same.

20 Claims, 7 Drawing Sheets

(56) References Cited

FOREIGN PATENT DOCUMENTS

| | | | |
|---|---|---|---|
| EP | 2518204 | B1 | 10/2012 |
| EP | 2316580 | B1 | 7/2013 |
| EP | 2342378 | B1 | 6/2016 |
| ES | 2315680 | T3 | 4/2009 |
| KR | 20070063997 | A | 6/2007 |
| WO | WO2019094355 | A1 | 5/2019 |

* cited by examiner

DRYER APPLIANCE AND INFUSER ASSEMBLY

FIELD OF THE INVENTION

The present subject matter relates generally to dryer appliances, and more particularly to and more particularly to additive or infusion dispensers for dryer appliances.

BACKGROUND OF THE INVENTION

Dryer appliances generally include a cabinet with a drum mounted therein. In some dryer appliances, a motor rotates the drum during operation of the dryer appliance, e.g., to tumble articles located within a chamber defined by the drum. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance.

In some instances, it may be desirable to provide certain objects or fluids for the treatment of articles within a dryer appliance. For instance, dryer sheets are commonly placed within the drum of a dryer appliance to affect the smell of the fabrics or clothes being treated (i.e., tumbled and/or dried) in a specific laundry load. Additionally or alternatively, some users may add concentrated scent pellets or oils to the basket for each new drying load. However, difficulties exist with such approaches. Specifically, a user must generally remember to supply a specific object or fluid to each individual drying load. Moreover, in many cases a user must estimate or guess how much of the specific object or fluid is appropriate for an individual load. Still further, especially in the case of concentrated scent pellets or oils, it is common for the effects of such additives to be localized or isolated to certain garments (or even sub-portions of specific garments) instead of evenly covering the entire drying load. Although attempts have been to provide automated, electronic dispensing systems to add oils or scent-dispensing additives to a drying load, such measuring and dispensing assemblies may increase cost and complexity of an appliance.

Accordingly, a dryer appliance having an additive or infusion assembly for delivering certain additives affecting the smell or performance of fabrics would be desirable. More particularly, an additive dispensing assembly that provides a suitable additive that can be evenly distributed over one or more loads (e.g., without requiring one or more electrically controlled or electronic parts) would be especially desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a dryer appliance is provided. The dryer appliance may include a cabinet, a drum, a supply line, an infuser reservoir, and an air impeller. The drum may be rotatably mounted within the cabinet, the drum defining a drying chamber for the receipt of clothes for drying. The supply line may define an air path in upstream fluid communication with the drying chamber. The supply line may extend from a line inlet to a line outlet. The infuser reservoir may be attached to the supply line along the air path and in fluid communication therewith. The air impeller may be mounted along the supply line in rotational engagement with the drum to be rotated by the same.

In another exemplary aspect of the present disclosure, a dryer appliance is provided. The dryer appliance may include a cabinet, a drum, a supply line, a roller wheel, an infuser reservoir, an air impeller, and an air-porous basket. The drum may be rotatably mounted within the cabinet, the drum defining a drying chamber for the receipt of clothes for drying. The supply line may define an air path in upstream fluid communication with the drying chamber. The supply line may extend from a line inlet to a line outlet. The infuser reservoir may be attached to the supply line along the air path and in fluid communication therewith. The roller wheel may be rotatably disposed on the drum to rotate along an outer surface of the drum. The air impeller may be attached to the roller wheel in rotational engagement with the drum. The infuser reservoir may be attached to the supply line along the air path and in fluid communication therewith. The air-porous basket may be selectively received within the infuser reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
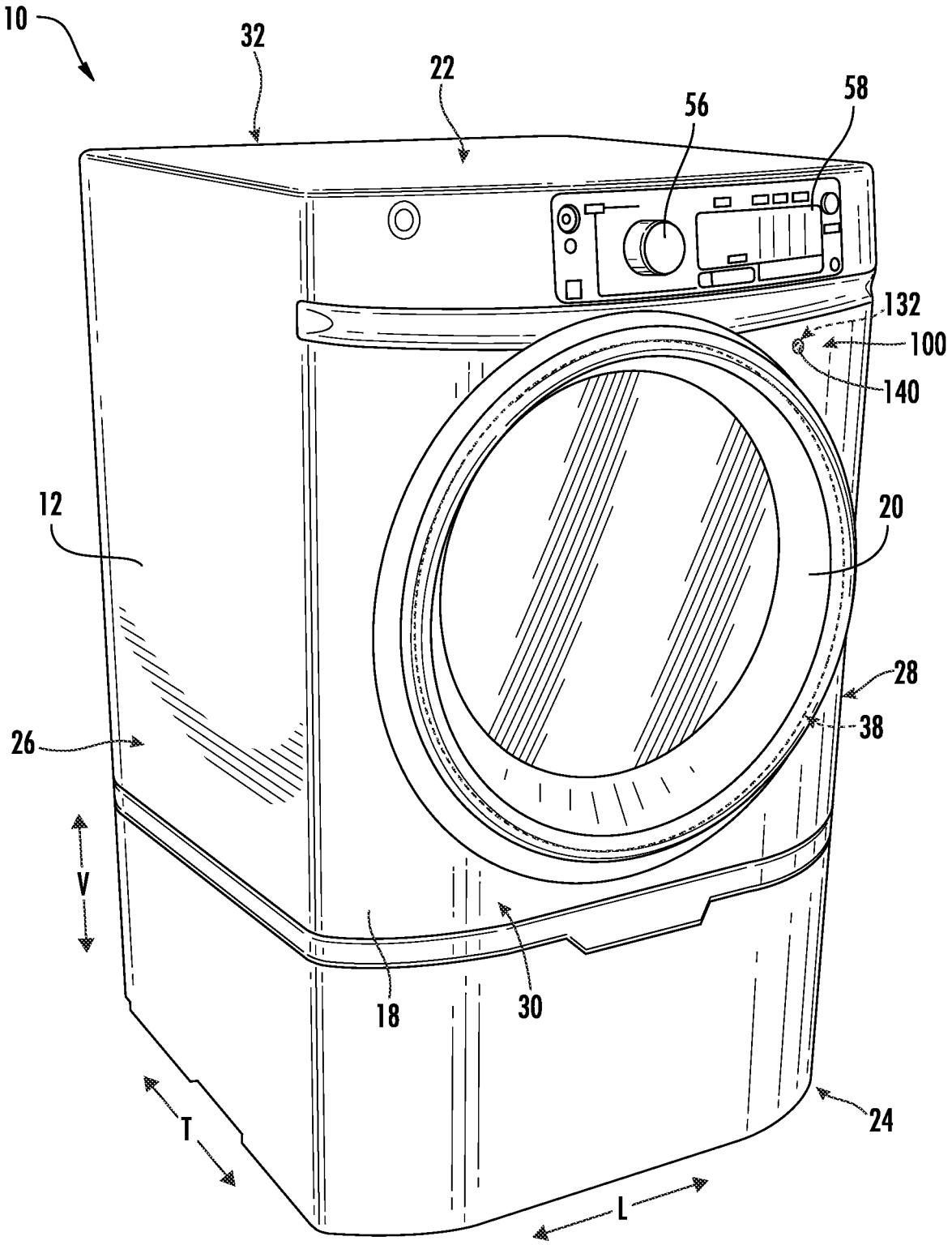
FIG. 1 provides a perspective view of a dryer appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
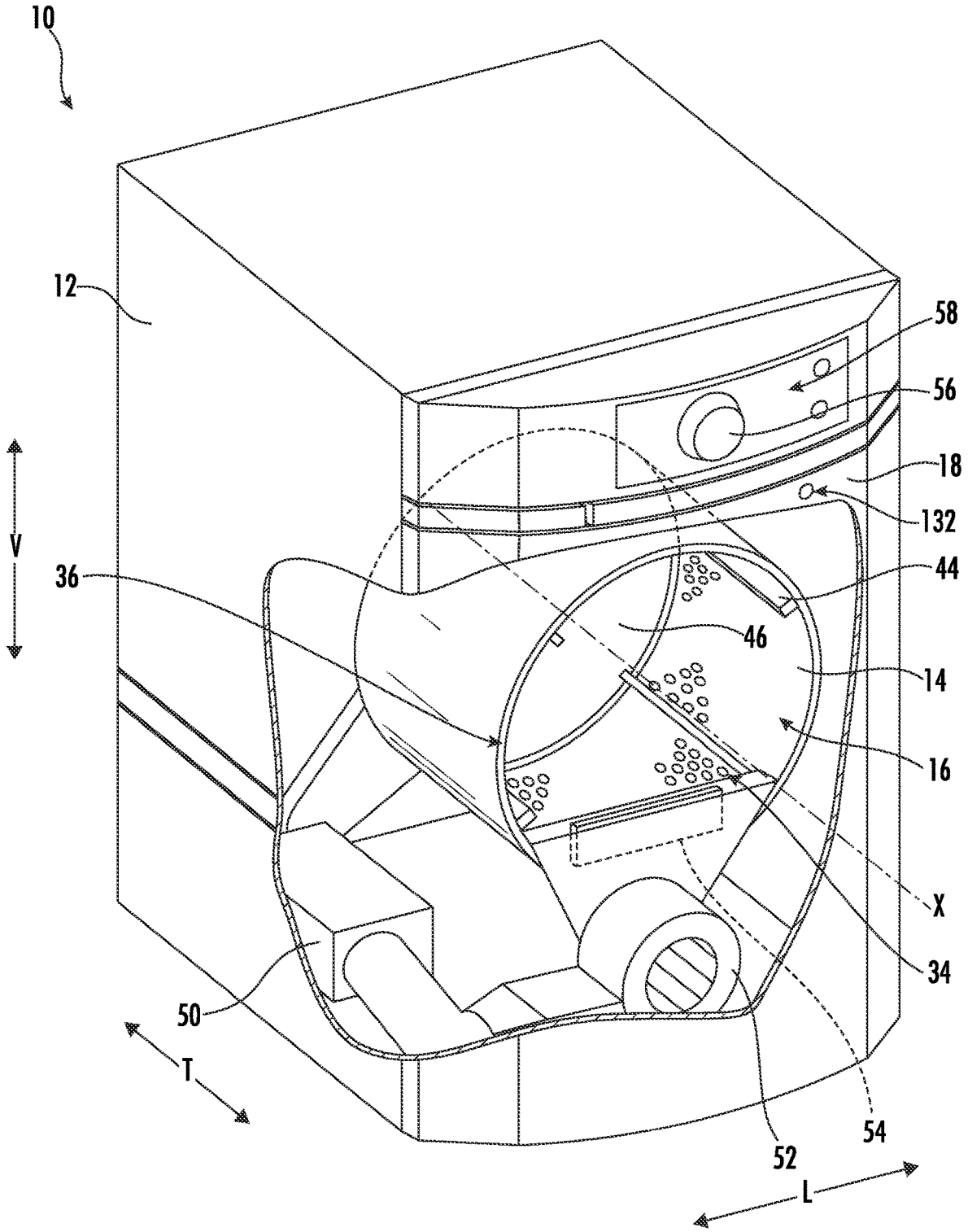
FIG. 2 provides a perspective view of the exemplary dryer appliance of FIG. 1 with a portion of a cabinet of the dryer appliance removed to reveal an interior of the dryer appliance.
Figure 3:
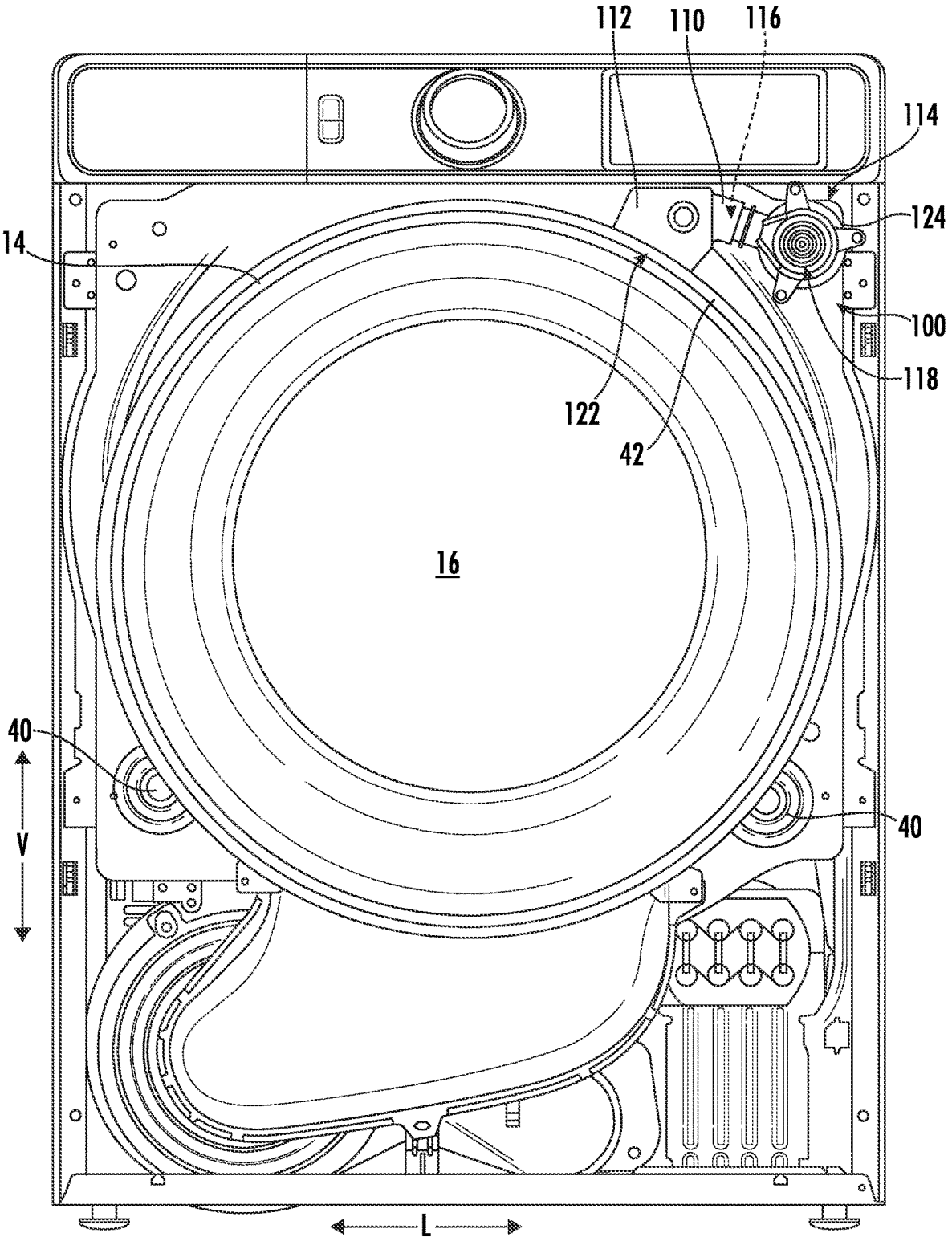
FIG. 3 provides a front elevation view of the exemplary dryer appliance of FIG. 1 with a front panel of a cabinet of the dryer appliance removed to reveal an infusion assembly.
Figure 4:
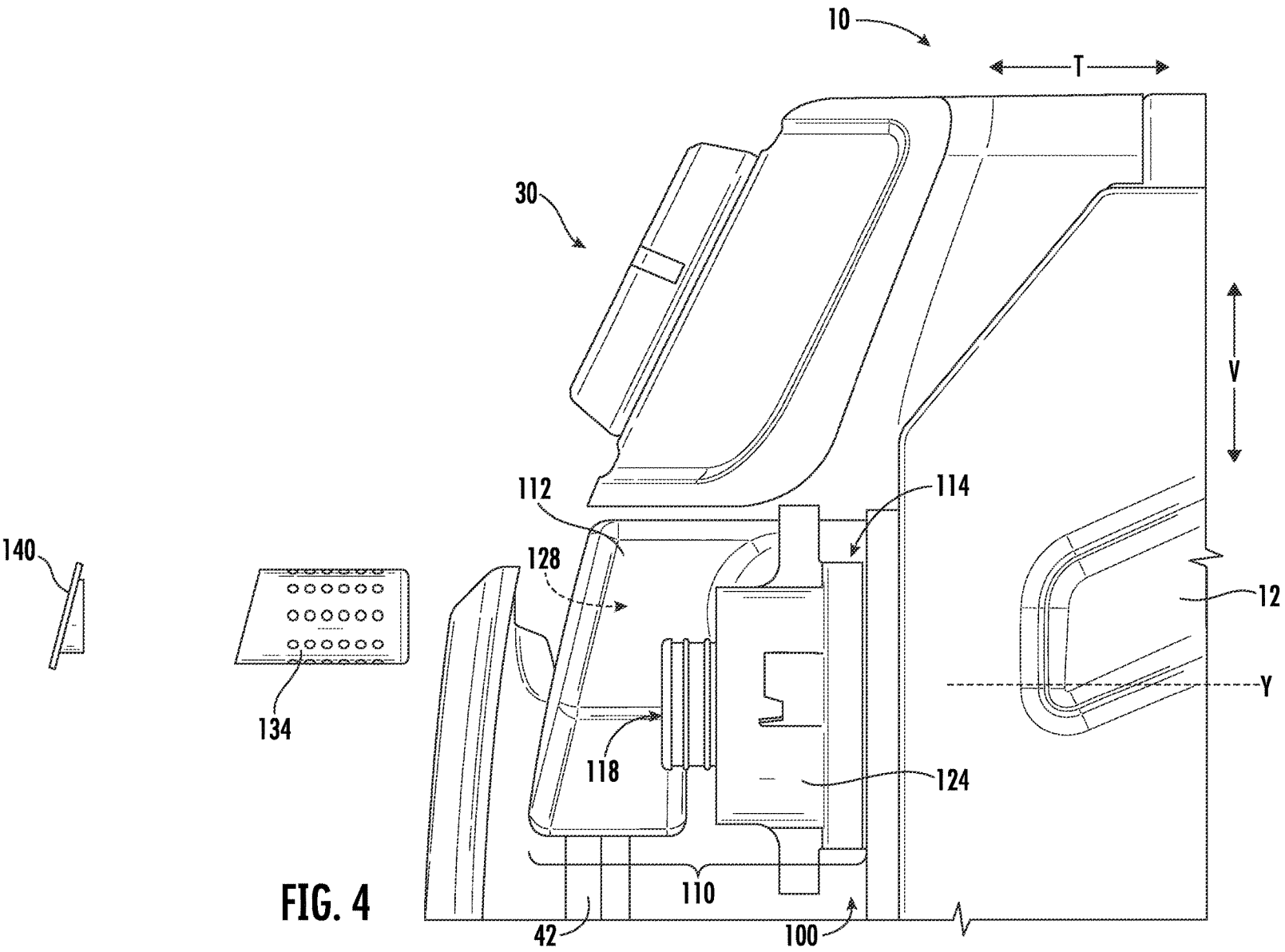
FIG. 4 provides a side elevation view of a top portion of the exemplary dryer appliance of FIG. 3, including the infusion assembly, with a portion of the assembly separated for clarity.
Figure 5:
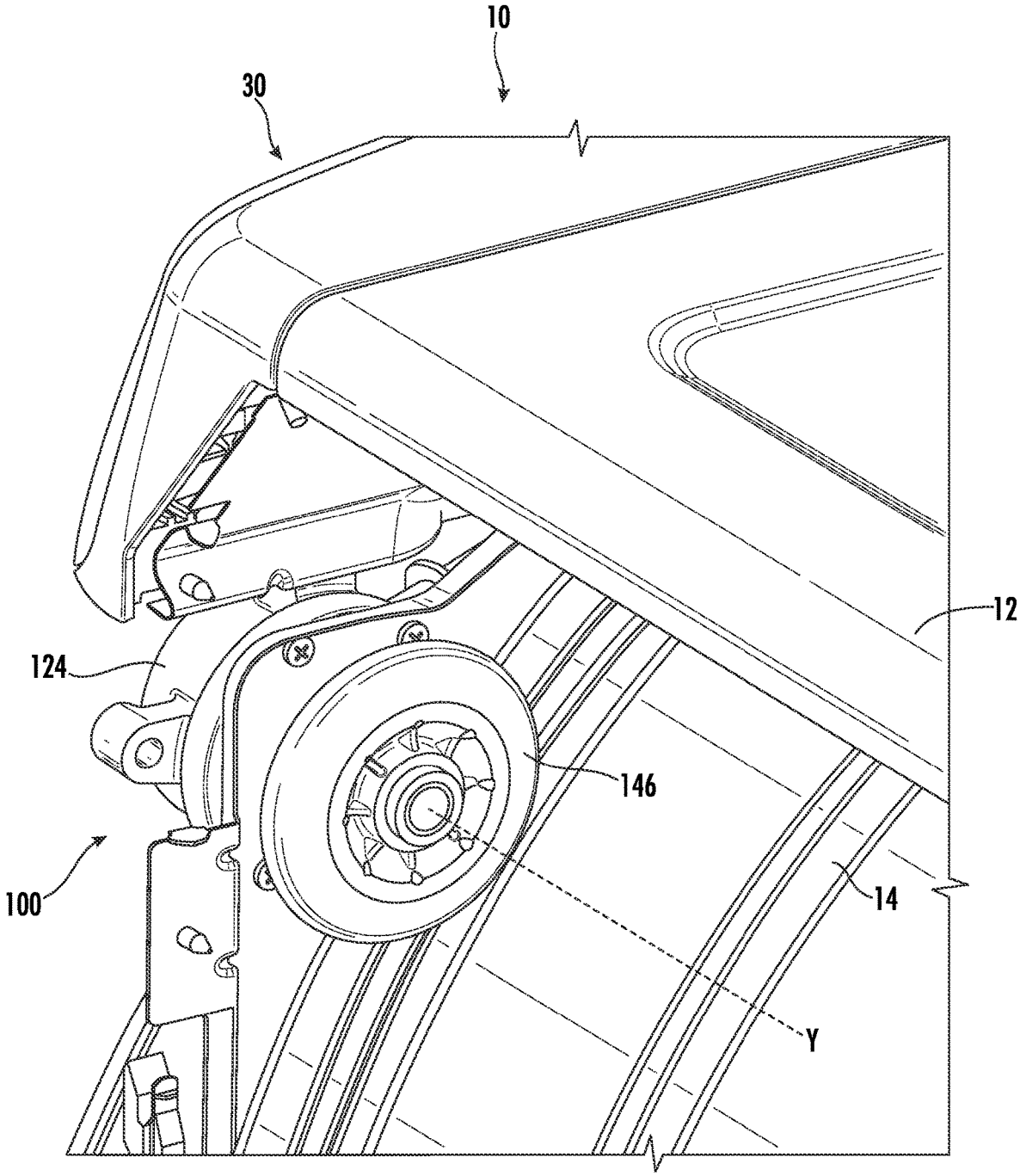
FIG. 5 provides a rear perspective view of a top portion of the exemplary dryer appliance of FIG. 3, including the infusion assembly, with portions of the cabinet removed for clarity.
Figure 6:
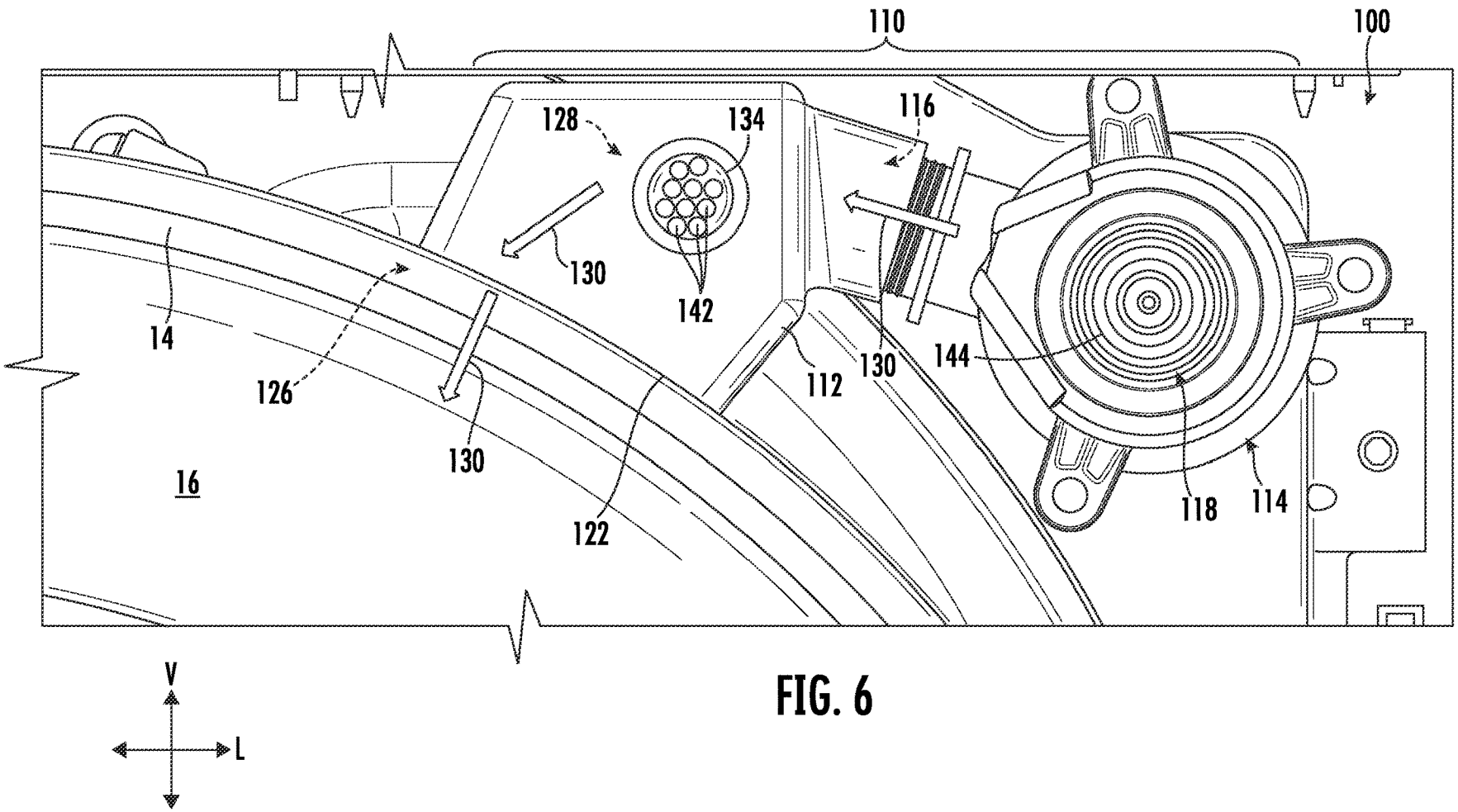
FIG. 6 provides a front elevation view of a top portion of the exemplary dryer appliance of FIG. 3, including the infusion assembly, with a portion of the cabinet removed for clarity and arrows illustrating airflow during use.
Figure 7:
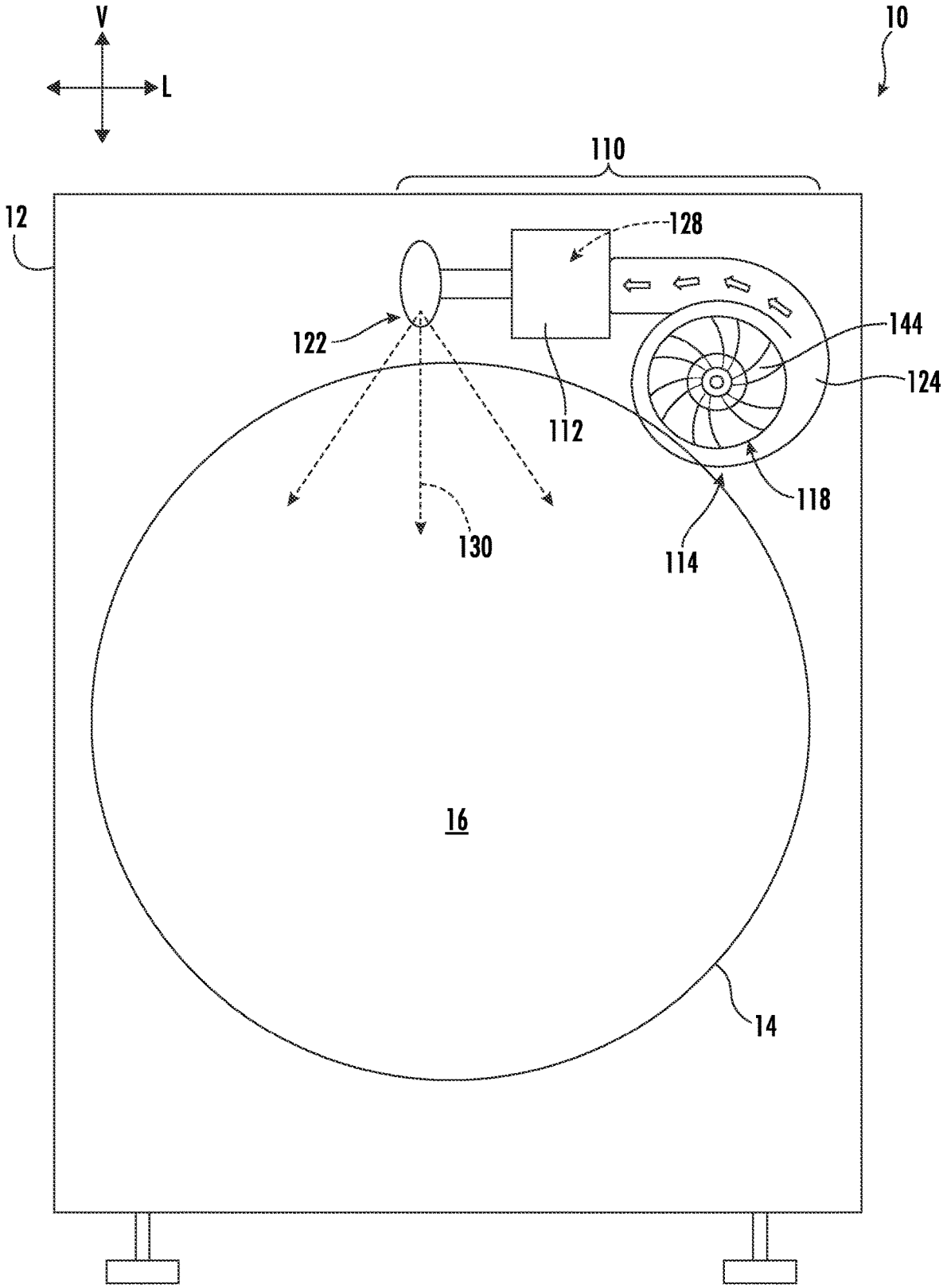
FIG. 7 provides a schematic elevation view of the exemplary dryer appliance of FIG. 3 during use.

Referring now to the figures, FIGS. 1 and 2 provide perspective views of a dryer appliance 10 according to an exemplary embodiment of the present disclosure. FIG. 3 provides an elevation view of dryer appliance 10, wherein a front panel 18 has been removed for clarity. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For example, dryer appliance 10 illustrated in FIGS. 1 and 2 is an electric dryer appliance with electric heating element for heating air. In alternative exemplary embodiments, dryer appliance 10 may be a gas dryer appliance with gas burners for heating air.

Dryer appliance 10 includes a cabinet 12 that extends between a top 22 and a bottom 24 along the vertical direction V, between a left side 26 and a right side 28 along the lateral direction L, and between a front 30 and a rear 32 along the transverse direction T. Within cabinet 12 is a drum 14 or container 14 mounted for rotation about a substantially horizontal axis X. Drum 14 is generally cylindrical in shape and defines a chamber 16 for receipt of articles for drying. Thus, clothing articles and other fabrics may be loaded into chamber 16 of drum 14 and dried therein. In some embodiments, drum 14 defines a plurality of holes 34. A chamber opening 36 is defined by drum 14 in order to allow a user to access to drying chamber 16 through a coaxial opening 38 defined by cabinet 12 (e.g., for loading and unloading of articles, such as clothing or other fabrics) into drying chamber 16. A motor (not shown) is mounted within the cabinet 12 in mechanical communication with the drum 14 to rotate drum 14 about the defined drum rotation axis X, as would be understood.

A door 20 is movably mounted to cabinet 12 (e.g., on a front panel 18 of cabinet 12) to permit selective access to chamber 16 of drum 14 through opening 38. Optionally, one or more support rollers 40 may be provided (e.g., along a bottom surface or otherwise at a bottom half of drum 14 below rotation axis X). Such support rollers 40 may, for instance, be rotatably mounted within cabinet 12 at fixed positions (e.g., relative to cabinet 12 or rotation axis X) in rotational engagement with drum 14. Thus, rotation of drum 14 may prompt or cause rotation of a portion of each support roller 40. In particular, a corresponding wheel of each support roller 40 may roll along the outer surface of drum 14 as drum 14 itself rotates abouts rotation axis X. As a result, each support roller 40 may define a discrete roller axis that is parallel to rotation axis X.

In certain embodiments, a stationary flange 42 fixed within the cabinet 12 (e.g., coaxial to opening 38 and chamber opening 36). For instance, stationary flange 42 may be disposed about opening 38. As shown, stationary flange 42 is disposed between opening 38 and the drum 14 along the transverse direction T. In optional embodiments, appliance 10 includes a pedestal or drawer mounted at or defining a bottom portion of the main cabinet 12 body.

In some embodiments, a plurality of tumbling ribs 44 are provided within drum 14 to lift articles disposed therein and then allow them to tumble back to the bottom of drum 14 as drum 14 rotates. Drum 14 may include a rear wall 46 (e.g., rotatably supported within cabinet 12 by a suitable fixed bearing) defining a rear portion or extreme of drying chamber 16. Rear wall 46 can be fixed or can be rotatable. A plurality of holes receive hot air that has been heated by a heating system 50 mounted within cabinet 12. Generally, heating system 50 includes one or more heating elements (e.g., electric elements or gas burners) and a blower fan 52 mounted along a ducted drying air path. During use, air may be drawn from drum 14 by blower fan 52. The air passes through a lint or screen filter 54 which traps lint particles. As the air passes from the blower fan 52, it is passed into the heating system 50. Heated air exits heating system 50 and returns to drum 14. After they have been dried, the articles are removed from drum 14 via opening 38.

In some embodiments, dryer appliance 10 includes a cycle selector knob 56 mounted on a cabinet control panel 58. Cycle selector knob 56 and other control inputs of cabinet control panel 58 are in communication with a controller. Signals generated in the controller operate a drum motor and heater assembly in response to a position of selector knob 56. Alternatively, a touch screen type interface may be provided. The controller may include a memory and one or more microprocessors, CPUs or the like, such as general or special purpose microprocessors operable to execute programming instructions or micro-control code associated with operation of dryer appliance 10. The memory may represent random access memory such as DRAM, or read only memory such as ROM or FLASH. In one embodiment, the processor executes programming instructions stored in memory. The memory may be a separate component from the processor or may be included onboard within the processor. Alternatively, the controller may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller may be positioned in a variety of locations throughout dryer appliance 10. For example, the controller may be located at, adjacent to, or integral to cabinet control panel 58 in cabinet 12. In such an embodiment, input/output ("I/O") signals may be routed between controller and various operational components of dryer appliance 10. As an example, the various operational components of dryer appliance 10 may be in communication with controller via one or more signal lines or shared communication buses.

Turning now especially to FIGS. 3 through 7, various views are provided of dryer appliance 10, including an infusion assembly 100. As shown, infusion assembly 100 may generally include a supply line 110 and an infuser reservoir 112 that is attached to supply line 110. As shown, a passive blower 114 may further be included with supply line 110 (e.g., as a portion thereof). It is understood that supply line 110 may be provided as any singular or plurality of suitable pipes or conduits (e.g., having non-permeable wall) for directing air therethrough and through at least a portion of infuser reservoir 112. As will be described in detail below, one or more additives (e.g., scent pellets 142) may be provided to infuser reservoir 112 to treat or affect articles within drying chamber 16 (e.g., as drum 14 rotates or spins).

Generally, supply line 110 is mounted on or within cabinet 12 and defines an air path 116 in upstream fluid communication with drying chamber 16. Thus, supply line 110 may direct an infusion airflow 130 along the air path 116 and to the drying chamber 16. As shown, supply line 110 extends from a line inlet 118 to a line outlet 122 that is downstream from the line inlet 118. Thus, air (e.g., ambient air outside of drying chamber 16) may be drawn into the line inlet 118 before flowing along the air path 116 and through the line outlet 122 to the drying chamber 16. In some embodiments, the line inlet 118 is mounted within cabinet 12. In particular, line inlet 118 may be held apart from the outer surface of drum 14 (e.g., radially outward and outside of drying chamber 16) to draw air from the region within cabinet 12 that surrounds drum 14. Optionally, line inlet 118 may be mounted above cabinet 12. In the illustrated embodiments, line inlet 118 is defined by an impeller housing 124 of passive blower 114.

Apart and downstream from line inlet 118, line outlet 122 is mounted within cabinet 12 (e.g., below line inlet 118). In some embodiments, and since drum 14 itself rotates within cabinet 12, line outlet 122 is mounted on or defined through a stationary member. In other words, at or proximal to line outlet 122, supply line 110 may be attached to a stationary or non-rotating member. For instance, supply line 110 may be attached to stationary flange 42. In some such embodiments, stationary flange 42 defines a radial aperture 126 on or through which line outlet 122 is disposed. As shown, radial aperture 126 may be open to drying chamber 16. Thus, radial aperture 126 may be downstream from supply line 110 to permit air from supply line 110 (e.g., infusion airflow 130). Separate from or in addition to attachment to stationary flange 42, line outlet 122 may be mounted or held at an upper half of drum 14. In other words, line outlet 122 may be disposed above rotation axis X. In some embodiments, line outlet 122 is disposed at the top fourth of the drum 14 (i.e., such that about 75% of the vertical height of drum 14 is positioned below line outlet 122). Notably, any water within drum 14 may be prevented from entering supply line 110.

As noted above, infuser reservoir 112 is attached to supply line 110. Specifically, infuser reservoir 112 is attached along the air path 116 between line inlet 118 and line outlet 122. Generally, infuser reservoir 112 defines a reservoir chamber 128 to communicate with drum 14 or drying chamber 16. To this end, infuser reservoir 112 may be in fluid communication with air path 116. For instance, at least a portion of the air path 116 for supply line 110 may be joined or partially defined by the reservoir chamber 128. At least a portion of the infusion airflow 130 through supply line 110 may, thus, be forced to pass through the reservoir chamber 128 (e.g., before flowing to the drying chamber 16). In some embodiments, at least a portion of infuser reservoir 112 is held above drum 14. For instance, infuser reservoir 112 may be held directly above drum 14.

Optionally, a panel aperture 132 may be defined through cabinet 12 (e.g., at front panel 18) to permit access to reservoir chamber 128. Specifically, panel aperture 132 may be radially spaced apart from opening 38 and, thus, not coaxial with opening 38. A corresponding aperture may be coaxial with panel aperture 132 and defined through supply line 110 (e.g., upstream from line outlet 122). In turn, a user may be able to add or remove additives to reservoir chamber 128 through panel aperture 132 and from an area outside of cabinet 12. In certain embodiments, panel aperture 132 is parallel to the opening 38. In some embodiments, a reservoir lid 140 is selectively mounted on or otherwise received across panel aperture 132. Reservoir lid 140 may removably attach to cabinet 12 (e.g., via one or more suitable threads, snaps, clips, friction fit, etc.). A user may, in turn, mount or remove reservoir lid 140 in order to access reservoir chamber 128. Thus, reservoir lid 140 may be used to cover the panel aperture 132 (e.g., during use of dryer appliance 10).

During or prior to use, a user may supply one or more additives (e.g., scent pellets 142) to infuse with or affect air flowing through infuser reservoir 112 (e.g., and supply line 110 prior to delivered to drying chamber 16). Advantageously, the additives may infuse the air without needing to be measured out or applied directly to articles within the drying chamber 16. Additionally or alternatively, the infusion and airflow may occur throughout a drying operation, advantageously ensuring the additive remains on the articles following expiration of the dry cycle.

In optional embodiments, an air-porous basket 134 (e.g., mesh or solid basket defining a plurality of apertures) is provided to hold or contain additives. Specifically, air-porous basket 134 may be provided for placement within reservoir chamber 128. Moreover, air-porous basket 134 may hold one or more additives (e.g., scent pellets 142) therein. In some embodiments, air-porous basket 134 may be received through or held, at least in part, within panel aperture 132. For instance, air-porous basket 134 may be selectively held within panel aperture 132 and thus removed from or attached to cabinet 12 (e.g., to add or remove additives from infusion assembly 100). During use, air-porous basket 134 may be at least partially received within infuser reservoir 112. As air flows through the air path 116, additives within air-porous basket 134 may be permitted to infuse the air while remaining held within basket 134.

In some embodiments, a passive blower 114 having a rotating air impeller 144 is provided. For instance, an impeller housing 124 of passive blower 114 may mounted to the rest of supply line 110 to define at least a portion of air path 116. Optionally, passive blower 114 may be mounted upstream from infuser reservoir 112 (e.g., notably restricting air flowing from infuser reservoir 112 to line inlet 118).

Generally, air impeller 144 is rotatably mounted along the supply line 110 in rotational engagement within the drum 14 such that the rotation of drum 14 is generally transferred to air impeller 144. For instance, air impeller 144 may be rotatably mounted within impeller housing 124. Moreover, the rotational engagement of air impeller 144 with the drum 14 (e.g., via one or more intermediate members) may ensure that rotation of air impeller 144 occurs with or is otherwise mechanically prompted by rotation of the drum 14. Rotation of the air impeller 144 may motivate or otherwise generate the infusion airflow 130. Notably, such an airflow 130 may occur without requiring a separate or dedicated motor, electric connection, or electronic device.

In some embodiments, passive blower 114 includes a roller wheel 146 that connects or mechanically engages the air impeller 144 with the drum 14. Roller wheel 146 may, for instance, be rotatably mounted within cabinet 12 at a fixed position (e.g., relative to cabinet 12 or rotation axis X) in rotational engagement with drum 14. For instance, roller wheel 146 may be disposed on or in contact with the drum 14. Specifically, a rim of roller wheel 146 may be placed on the outer surface of drum 14. Roller wheel 146 may roll along the outer surface of drum 14 as drum 14 itself rotates about rotation axis X. Thus, rotation of drum 14 may prompt or cause rotation of a portion of roller wheel 146. Optionally, roller wheel 146 may define a wheel axis Y that is parallel to rotation axis X. Additionally or alternatively, roller wheel 146 itself may be mounted above rotation axis X and, thus, at the top half of drum 14.

In optional embodiments, air impeller 144 is fixed to roller wheel 146 and, thus, rotates in tandem with the same. For instance, a drive shaft may extend along the wheel axis Y between roller wheel 146 and air impeller 144. As a result, rotation of the drum 14 may prompt simultaneous rotation of roller wheel 146 and the air impeller 144 (e.g., in the opposite circumferential direction from the drum 14). Rotation of the air impeller 144 along the air path 116 may moreover draw ambient air through the line inlet 118 and along the air path 116, as described above. Notably, the mechanical and rotational engagement between the drum 14, roller wheel 146, and air impeller 144 may provide a robust and reliable assembly for infusing air during operation of the dryer appliance 10.

This written description us examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet to rotate about a rotation axis, the drum defining a drying chamber for a receipt of clothes for drying;

a supply line defining an air path in upstream fluid communication with the drying chamber, the supply line extending from a line inlet to a line outlet;

an infuser reservoir attached to the supply line along the air path and in fluid communication therewith;

an air impeller mounted along the supply line in rotational engagement with the drum to be rotated by the same; and a roller wheel rotatably disposed on the drum to rotate along an outer surface of the drum, the roller wheel rotationally engaging the air impeller with the drum.

2. The dryer appliance of claim 1, wherein the line inlet is mounted within the cabinet to receive air therefrom.

3. The dryer appliance of claim 1, wherein the line outlet is mounted above the rotation axis upstream from the drying chamber.

4. The dryer appliance of claim 1, wherein the cabinet defines an opening permitting access to the drying chamber, wherein the dryer appliance further comprises a stationary flange fixed within the cabinet about the opening between the opening and the drum, and wherein the stationary flange defines a radial aperture downstream from the supply line to permit air therefrom to the drying chamber.

5. The dryer appliance of claim 1, further comprising an air-porous basket selectively received within the infuser reservoir.

6. The dryer appliance of claim 5, wherein the cabinet comprises a front panel defining an opening and a panel aperture radially spaced apart from the opening in parallel therewith, the air-porous basket being selectively held within the panel aperture apart from the opening.

7. The dryer appliance of claim 1, wherein the air impeller is fixed to the roller wheel to rotate in tandem therewith.

8. The dryer appliance of claim 7, wherein the roller wheel defines a wheel axis about which the roller wheel rotates, the wheel axis being parallel to the rotation axis of the drum.

9. The dryer appliance of claim 1, wherein the roller wheel is mounted above the rotation axis.

10. A dryer appliance comprising:

a cabinet;

a drum rotatably mounted within the cabinet to rotate about a rotation axis, the drum defining a drying chamber for a receipt of clothes for drying;

a supply line defining an air path in upstream fluid communication with the drying chamber, the supply line extending from a line inlet to a line outlet;

a roller wheel rotatably disposed on the drum to rotate along an outer surface of the drum;

an air impeller attached to the roller wheel in rotational engagement with the drum, wherein the air impeller is fixed to the roller wheel to rotate in tandem therewith;

an infuser reservoir attached to the supply line along the air path and in fluid communication therewith; and an air-porous basket selectively received within the infuser reservoir.

11. The dryer appliance of claim 10, wherein the line inlet is mounted within the cabinet to receive air therefrom.

12. The dryer appliance of claim 10, wherein the line outlet is mounted above the rotation axis upstream from the drying chamber.

13. The dryer appliance of claim 10, wherein the cabinet defines an opening permitting access to the drying chamber, wherein the dryer appliance further comprises a stationary flange fixed within the cabinet about the opening between the opening and the drum, and wherein the stationary flange defines a radial aperture downstream from the supply line to permit air therefrom to the drying chamber.

14. The dryer appliance of claim 10, wherein the cabinet comprises a front panel defining an opening and a panel aperture radially spaced apart from the opening in parallel therewith, the air-porous basket being selectively held within the panel aperture apart from the opening.

15. The dryer appliance of claim 10, wherein the roller wheel defines a wheel axis about which the roller wheel rotates, the wheel axis being parallel to the rotation axis of the drum.

16. The dryer appliance of claim 10, wherein the roller wheel is mounted above the rotation axis.

17. A dryer appliance comprising:

a cabinet;

a drum rotatably mounted within the cabinet to rotate about a rotation axis, the drum defining a drying chamber for a receipt of clothes for drying;

a blower fan in fluid communication with the drying chamber a supply line defining an air path in upstream fluid communication with the drying chamber in fluid parallel to the blower fan, the supply line extending from a line inlet to a line outlet;

an infuser reservoir attached to the supply line along the air path and in fluid communication therewith;

an air impeller mounted along the supply line in rotational engagement with the drum to be rotated by the same; and a roller wheel rotatably disposed on the drum to rotate along an outer surface of the drum, the roller wheel rotationally engaging the air impeller with the drum.

18. The dryer appliance of claim 17, wherein the air impeller is fixed to the roller wheel to rotate in tandem therewith.

19. The dryer appliance of claim 18, wherein the roller wheel defines a wheel axis about which the roller wheel rotates, the wheel axis being parallel to the rotation axis of the drum.

20. The dryer appliance of claim 17, wherein the roller wheel is mounted above the rotation axis.

* * * * *